US009140132B2

(12) United States Patent
Faulder et al.

(10) Patent No.: US 9,140,132 B2
(45) Date of Patent: Sep. 22, 2015

(54) TURBINE BLADE SUPPORT

(75) Inventors: Leslie John Faulder, San Diego, CA (US); Olivier Jacques Lamicq, Poway, CA (US)

(73) Assignee: Solar Turbines Incorporated, San Diego, CA (US)

( * ) Notice: Subject to any disclaimer, the term of this patent is extended or adjusted under 35 U.S.C. 154(b) by 723 days.

(21) Appl. No.: 13/485,072

(22) Filed: May 31, 2012

(65) Prior Publication Data

US 2013/0319008 A1 Dec. 5, 2013

(51) Int. Cl.
*F01D 5/30* (2006.01)
*F01D 5/14* (2006.01)

(52) U.S. Cl.
CPC ..... *F01D 5/3007* (2013.01); *F01D 5/147* (2013.01); *F05D 2240/80* (2013.01); *F05D 2260/941* (2013.01); *Y10T 29/49318* (2015.01)

(58) Field of Classification Search
CPC ..... F01D 5/30; F01D 5/3007; F01D 5/147
USPC ..... 416/248, 193 A, 239
See application file for complete search history.

(56) References Cited

U.S. PATENT DOCUMENTS

| | | | | |
|---|---|---|---|---|
| 5,261,790 | A | 11/1993 | Dietz et al. | |
| 5,791,877 | A | 8/1998 | Stenneler | |
| 6,158,962 | A * | 12/2000 | Lee et al. | 416/193 A |
| 6,450,769 | B2 | 9/2002 | Szwedowicz | |
| 6,478,544 | B2 | 11/2002 | Brandl et al. | |
| 2009/0123286 | A1 | 5/2009 | Mace et al. | |
| 2010/0111700 | A1 | 5/2010 | Kim et al. | |
| 2010/0232975 | A1 | 9/2010 | Morris et al. | |

FOREIGN PATENT DOCUMENTS

GB 2112466 A 7/1983

* cited by examiner

*Primary Examiner* — Richard Edgar
(74) *Attorney, Agent, or Firm* — Finnegan, Henderson, Farabow, Garrett & Dunner, LLP

(57) ABSTRACT

A turbine blade is disclosed. The turbine blade includes a platform, an airfoil extending from one side of the platform, a root extending radially from another side of the platform, and a pocket located beneath the platform. The pocket is defined by a plurality of walls, and a pad is disposed in a corner of the pocket. The pad includes three pad corners and three sides connecting the three pad corners, wherein each side extends along a different one of the plurality of walls.

19 Claims, 7 Drawing Sheets

TURBINE BLADE SUPPORT

TECHNICAL FIELD

The present disclosure is directed to a turbine blade support of a gas turbine engine (GTE) and, more particularly, to a support pad disposed in an upper corner of a pocket of the turbine blade.

BACKGROUND

GTEs produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. The resulting hot gases are directed over blades of the turbine to spin the turbine and produce mechanical power.

Turbine blades and other components of GTEs are subject to high temperatures and high local stresses during operation. Components which undergo these high temperatures and stresses may be subject to mechanical failure, either from component breakage due to a reduced cross section of the component as a result of plastic deformation, or rupture where cracks initiate and propagate until the component is broken. For turbine blades, high local stresses may contribute to platform cracks and failures.

U.S. Patent Application Publication No. 2010/0232975 ("the '975 publication") describes a turbine blade assembly including a root connected to a platform, and an airfoil extending upwards from the platform. The '975 publication notes that the platform may experience stresses from rotation of the turbine blade assembly, and may fail due to plastic deformation caused by a combination of heat and stress. Accordingly, the turbine blade assembly of the '975 publication includes a number of ribs that are designed to increase the stiffness of the blade platform. Each rib, which can taper along the turbine blade root, extends outwardly towards a lateral edge of the platform.

SUMMARY

In one aspect, a turbine blade is disclosed. The turbine blade includes a platform, an airfoil extending from one side of the platform, a root extending radially from another side of the platform, and a pocket located beneath the platform. The pocket is defined by a plurality of walls, and a pad is disposed in a corner of the pocket. The pad includes three pad corners and three sides connecting the three pad corners, wherein each side extends along a different one of the plurality of walls.

In another aspect, a gas turbine engine is disclosed. The gas turbine engine includes a compressor system configured to compress a flow of air, a combustor system configured to combust a mixture of the air and a fuel to produce a hot gas flow. and a turbine system configured to use the hot gas flow to produce power. The turbine system includes a plurality of turbine blades, which include a platform, an airfoil extending radially from one side of the platform, a root extending radially from another side of the platform, and a pocket located beneath the platform. The pocket is defined by a plurality of walls, and a pad is disposed in a corner of the pocket. The pad includes three sides, wherein each side extends along a different one of the plurality of walls.

In yet another aspect, a method of reducing stress in a turbine blade of a gas turbine engine is disclosed. The method includes forming a triangular pad in a corner of a pressure-side pocket of the turbine blade, wherein the pad is formed beneath a platform and proximate a leading edge of the turbine blade.

DETAILED DESCRIPTION

Figure 1:
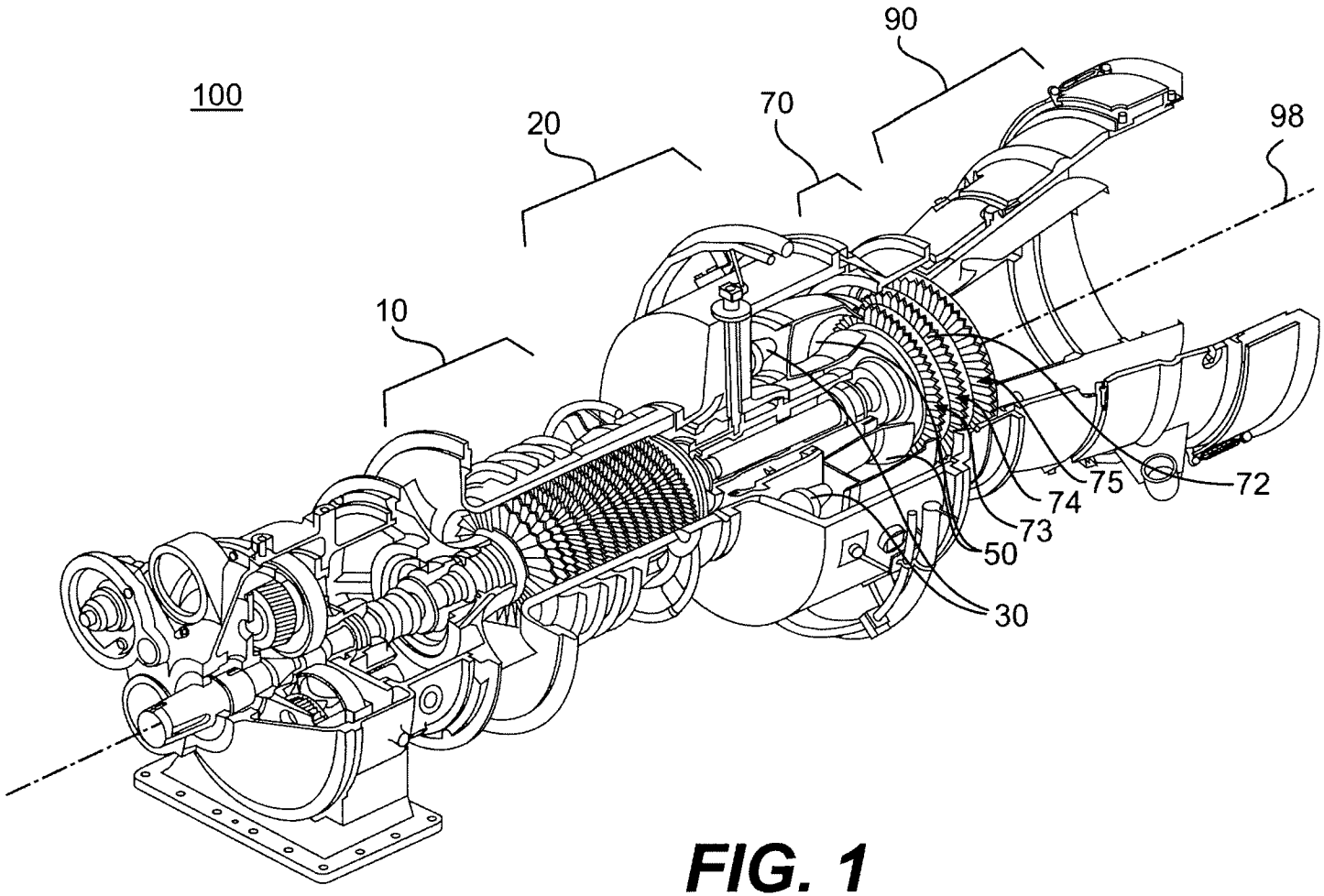
FIG. 1 is an illustration of an exemplary disclosed GTE.

FIG. 1 illustrates an exemplary gas turbine engine (GTE) 100. GTE 100 may have, among other systems, a compressor system 10, a combustor system 20, a turbine system 70, and an exhaust system 90 arranged along an engine axis 98. Compressor system 10 compresses air and delivers the compressed air to an enclosure of combustor system 20. The compressed air is then directed from the enclosure into a combustor 50. Liquid or gaseous fuel may be directed into the combustor 50 through the fuel injectors 30. The fuel burns in combustor 50 to produce combustion gases at high pressure and temperature. These combustion gases are used in the turbine system 70 to produce mechanical power. The turbine system 70 may further include a plurality of turbine blades 72 as part of a series of turbine rotors. Additionally, the turbine system 70 can include a plurality of turbine nozzles as part of a series of turbine stators (not shown). The turbine blades 72, rotors, nozzles, and stators can be included in a series of turbine stages, for example, a first stage 73, a second stage 74, and a third stage 75. Although only three stages 73, 74, 75 are illustrated in FIG. 1, more or less turbine stages may make up part of the turbine system 70. In operation, the turbine system 70 extracts energy from the combustion gases and directs the exhaust gases through exhaust system 90.

Figure 2:
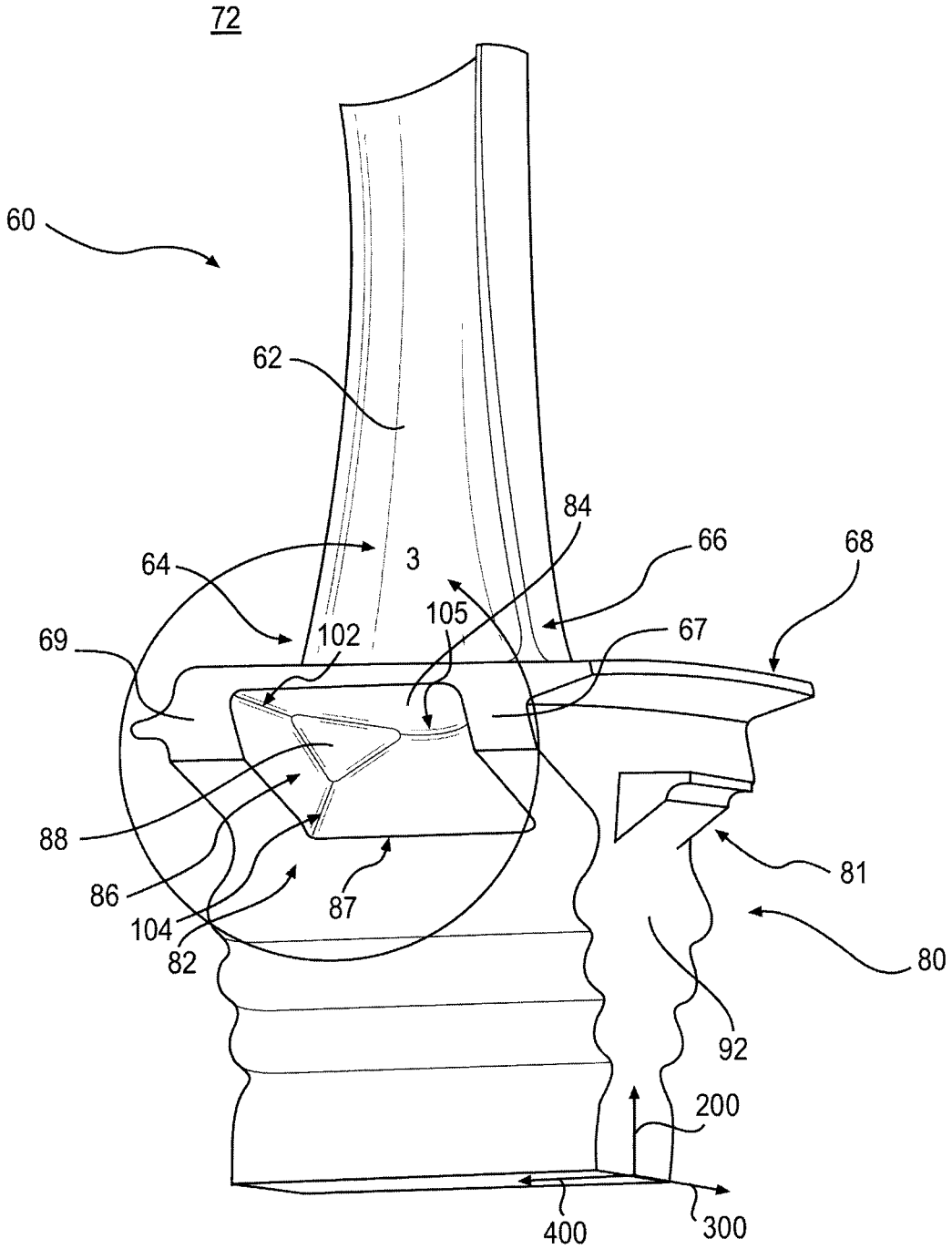
FIG. 2 is a first perspective view of an exemplary turbine blade of the GTE.

FIG. 2 is a perspective view of an exemplary turbine blade 72 of the GTE 100 shown in FIG. 1. FIG. 2 shows the turbine blade 72 separate from the GTE 100, and indicates a radial direction 200, a circumferential direction 300, and an axial direction 400 for when the turbine blade 72 is in place in the turbine system 70 of the GTE 100. The axial direction 400 may be parallel to the engine axis 98 shown in FIG. 1. Although not shown, these directions 200, 300, 400 are also applicable to FIGS. 4-7. The turbine blade 72 of FIG. 2 includes an airfoil 60 extending in the radial direction 200 from a turbine blade platform 68. A pressure-side forward damper arm 69 and a pressure side aft damper arm 67 can be said to extend from or be located below the platform 68. The damper arms 67, 69 can also be referred to as buttresses, support arms, or the like. The turbine blade 72 in FIG. 2, which is oriented to show a pressure side 62, further includes a leading edge 64 and a trailing edge 66. When the turbine blade 72 is disposed in the turbine section 70 of the GTE 100, the leading edge 64 is disposed more upstream of the flow of combustion gases than the trailing edge 66.

The turbine blade 72 further includes a root 80 extending from the platform 68, wherein the root includes a forward wall 91 (FIG. 4) and an aft wall 92 (FIG. 2). In some embodiments, the root 80 may exhibit a shape that can be referred to as a fir-tree shape. In other instances, however, other root shapes may be employed. Furthermore, when the turbine blade 72 is in place in a GTE, a bottom of the root may be flat and positioned along the axial direction 400, as shown in FIG. 2. In some instances (not shown), however, the root 80 may have a structure such that the root 80 is angled to match an angle of a slot of a turbine rotor. This angle, which can be referred to as a "broach angle," can be an angle from the forward wall 91 to the aft wall 92 with respect to an axial direction of the root 80. The axial direction (not shown) may be located along the root 80 perpendicular to both the forward wall 91 and the aft wall 92. In some instances, the broach angle can be between about zero degrees and about twenty-five degrees, for example, twelve degrees. When the root 80 is structured so as to include a broach angle, the turbine blade 72 may be slid into a slot of the turbine rotor in a direction substantially parallel to the engine axis 98, but angled from the forward wall 91 to the aft wall 92 by the broach angle.

Figure 3:
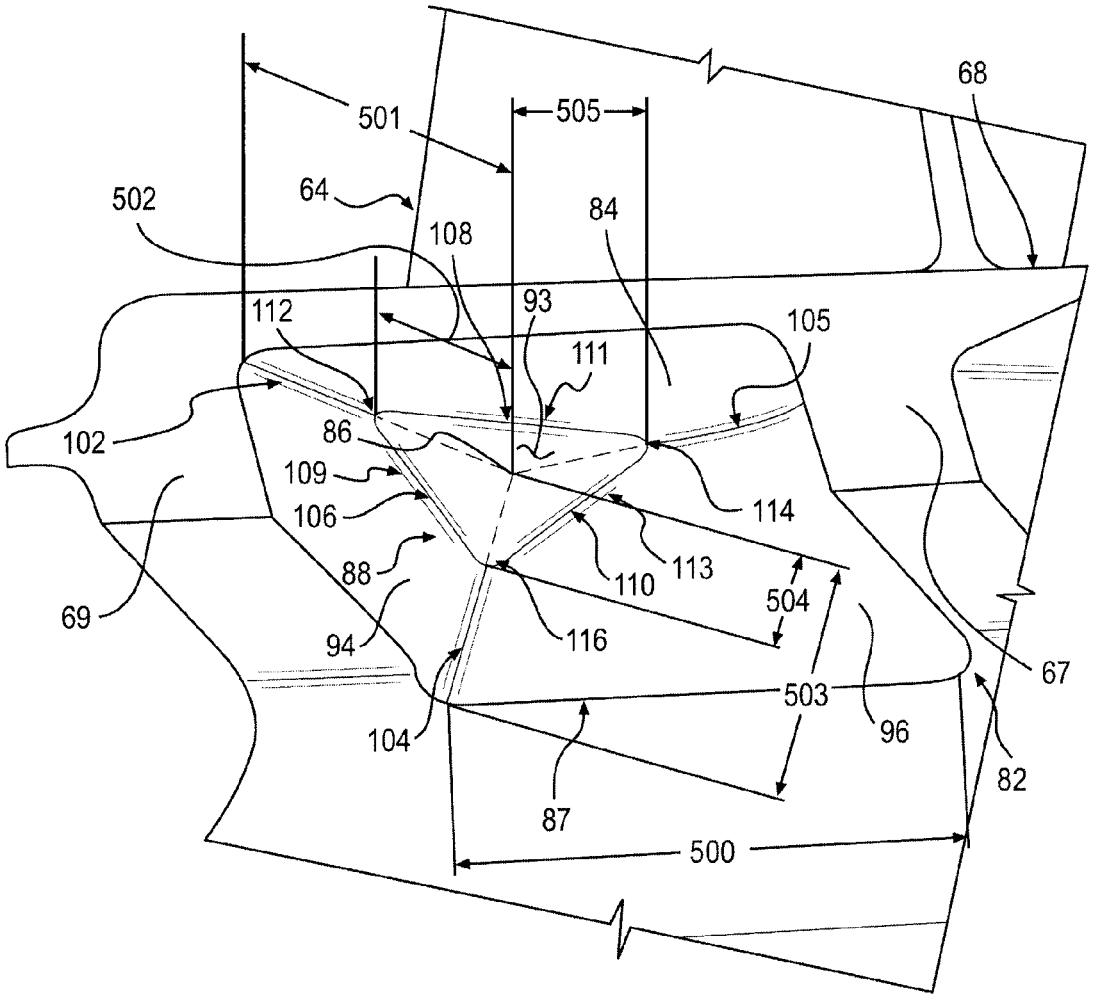
FIG. 3 is a magnified view of the encircled portion 3 of the turbine blade of FIG. 2
Figure 4:
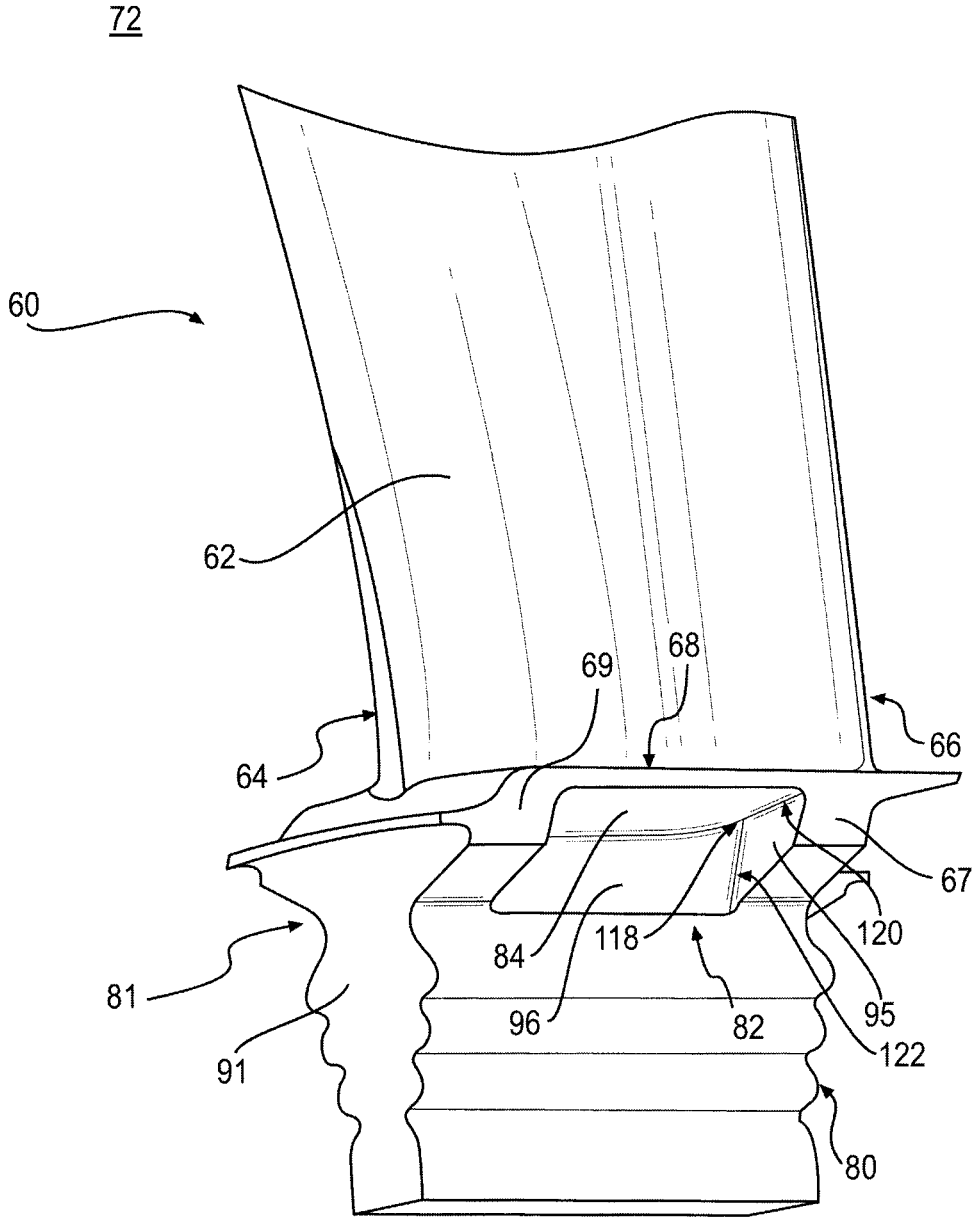
FIG. 4 is a second perspective view of the turbine blade of FIG. 2.

As shown in FIG. 2, the turbine blade 72 includes a pocket 82, referred to herein as a "pressure-side pocket." The pressure-side pocket 82 may be formed beneath the platform 68. In some instances, the area in which the pressure-side pocket 82 is formed may be an area between the platform 68 and the root 80, which can be referred to as the neck 81, or the shank, of the turbine blade 72. The pressure-side pocket 82 may be defined by an upper wall 84, which is an underside of the platform 68, as well as a bottom edge 87, a forward wall 94, an aft wall 95, and a side wall 96 (FIGS. 3 and 4). As illustrated in FIG. 2, the pressure-side pocket 82 includes a leading corner 86, in which a support pad 88 is disposed. As shown in FIG. 2, the support pad 88 may protrude from the leading corner 86, which may be located proximate or adjacent to the leading edge 64. The leading corner 86, and the support pad 88 located therein, can be referred to as being radially below the leading edge 64.

FIG. 3 is a magnified view of the encircled portion 3 of the turbine blade 72 shown in FIG. 2. Specifically, FIG. 3 shows the support pad 88 positioned in the leading corner 86 of the pressure-side pocket 82. The entire support pad 88 may be formed and positioned within the pressure-side pocket 82, such that the support pad 88 extends from the leading corner 86. The support pad 88 may be referred to herein as a pad, stiffener, gusset, triangular pad, local triangle, damper arm pad, corner pad, or the like. As described in more detail below, the pad 88 may be formed integrally with the turbine blade 72. The pad 88 is formed under the platform 68 beneath the leading edge 64 of the turbine blade 72.

FIG. 3 shows the pad 88 being formed as a triangular pad 88 having a face 93, three sides 106, 108, 110 and three pad corners 112, 114, 116. The sides 106, 108, 110 may be disposed between the pad corners 112, 114, 116 such that the sides 106, 107, 110 connect the pad corners 112, 114, 116. The sides 106, 108, 110 may be referred to as first, second, and third sides of the pad 88, respectively. Similarly, the pad corners 112, 114, 116 may be referred to as first, second, and third corners of the pad 88, respectively. As shown in FIGS. 2 and 3, the corners 112, 114, 116 may be rounded such that the pad 88 is not exactly triangular. In some instances, the face 93 may be flat, and referred to as planar. The sides 106, 108, 110 can be referred to as contacting, extending along, or lying adjacent to the upper wall 84, forward wall 94, and side wall 96, respectively. The corners, for example the first corner 112, the second corner 114, and the third corner 116, may be formed adjacent a forward fillet 102, and upper fillet 105, and a first side fillet 104 of the pressure-side pocket 82, respectively. As shown in FIG. 3, the forward fillet 102 may be formed between the upper wall 84 and the forward wall 94, the first side fillet 104 may be formed between the forward wall 94 and the side wall 96, and the upper filet 105 may be formed between the upper wall 84 and the side wall 96. The sides 106, 108, 110 may include fillets, for example, a first side pad fillet 109, a second side pad fillet 111, and a third side pad fillet 113. In some instances the pad 88 may be formed such that the three sides 106, 108, 110 have substantially equal lengths. In other instances, however, two or more of the sides 106, 108, 110 may have different lengths.

As shown in FIG. 3, the pressure-side pocket 82 can also include a width 500, a depth 501 to the leading corner 86, and a height 503 to the leading corner 86. The dashed lines are provided in FIG. 3 to show where the leading corner 86 of the turbine blade 72 is located. Specifically, the dashed lines show where the upper wall 84, forward wall 94, and side wall 96 may intersect absent the pad 88. The depth 501 can be along the forward fillet 102, the height can be along the first side fillet 104, and the width 500 can be along the bottom edge 87. As shown in FIG. 3, the pad 88 may be formed such that the first corner 112 is positioned at a first distance 502, the second corner 114 is positioned at a second distance 505, and the third corner 116 is positioned at a third distance 504. In some instances, the width 500 may be about 33.02 mm (about 1.30 inches), the depth 501 may be about 22.86 mm (about 0.90 inches), and the height 503 may be about 12.70 mm (about 0.50 inches). Regarding the pad 88, in some cases the first distance 502, the second distance 505, and the third distance 504 may each be between about 6.35 to 19.05 mm (about 0.25 to 0.75 inches). The pad 88 may thus extend the first distance 502 along about 25 to 85% of the depth 501, the second distance 505 along about 20 to 60% of the width 500, and the third distance 504 along about 50 to 100% of the height 503. For example, the pad 88 may be structured so as to define a first distance 502 of about 11.43 mm (about 0.45 inches), a second distance 505 of about 10.92 mm (about 0.43 inches), and a third distance 504 of about 6.35 mm (about 0.25 inches). In this example, the pad 88 may therefore extend along about 50% of the depth 501, about 33% of the width 500, and about 50% of the height 503.

The dimensions of the pad 88, that is, the lengths of the sides 106, 108, 110 and the radii of the corners 112, 114, 116 depend on the turbine blade 72 and the shape of the pressure-side pocket 82 in which the pad 88 is formed. As an example, the sides 106, 108, 110 may each have a length of between about 6.35 to 25.4 mm (about 0.25 to 1.0 inches). The corners 112, 114, 116 may each have a radius of about 1.27 to 2.54 mm (about 0.05 to 0.10 inches), or about 1.52 mm (about 0.06 inches). As used herein with respect to various dimensions, the term "about" can mean+/−5% of the value. For example, where the corners 112, 114, 116 may have a radius of about 1.52 mm (about 0.06 inches), the radii of the corners 112, 114, 116 may be from 1.44 to 1.60 mm (0.057 to 0.063 inches). All of the dimensions provided herein are provided as possible dimensions; however, because the shape of the pressure-side pocket 82 can depend on the turbine blade 72, and because the size of the pad 88 can depend on the turbine blade 72 and the shape of the pressure-side pocket 82, other dimensions are feasible.

Pad 88 can be a triangle or at least exhibit a triangle-like shape. As shown in FIG. 3, the pad 88 may be formed as a plane defined by three points, wherein the three points are the corners 112, 114, 116. The location of each of the corners 112, 114, 116 within the pressure-side pocket 82 may determine an angle at which the planar face 93 of the pad 88 is oriented. For example, changing the location of one or more of the corners 112, 114, 116 may change the orientation of the pad 88 within the pressure-side pocket 82. Furthermore, the corners 112, 114, 116 may be positioned so that the pad 88 does not extend to either the pressure side forward damper arm 69 of the platform 68, the aft wall 95 of the pressure-side pocket 82 (FIG. 4), or the bottom edge 87 of the pressure-side pocket 82. FIG. 3, for example, shows the corners 112, 114, 116 being located within the pressure-side pocket 82 and not at the pressure side forward damper arm 69, the aft wall 95, or the bottom edge 87, respectively. In other instances however, the pad 88 may extend to or at least be proximate to one or more of the pressure side forward damper arm 69, the aft wall 95, or the bottom edge 87.

FIG. 4 is a second perspective view of the turbine blade 72. Specifically, FIG. 4 shows a different view of the pressure side 62 than that shown in FIG. 3. As shown in FIG. 4, the pressure-side pocket 82 includes a trailing corner 118 defined by the upper wall 84 and the aft wall 95. The trailing corner 118 is located proximate or adjacent to the trailing edge 66, and may also be referred to as being positioned below the trailing edge 66. The pressure-side pocket 82 may further include an aft fillet 120 and a second side fillet 122. As shown in FIG. 4, the aft fillet 120 may be formed between the upper wall 84 and the aft wall 95, and the second side fillet 122 may be formed between the aft wall 95 and the side wall 96.

For the turbine blade 72 shown in FIGS. 2-4, forward fillet 102, first side fillet 104, upper fillet 105, aft fillet 120, and second side fillet 122 can be collectively referred to as the "pressure-side pocket fillets." The first side pad fillet 109, second side pad fillet 111, and third side pad fillet 113 can be collectively referred to as the "pad fillets." Each of the pressure-side pocket fillets 102, 104, 105, 120, and 122 and pad fillets 109, 111, 113 have a radius defining their respective curvature. In some instances, the pressure-side pocket fillets 102, 104, 105, 120, 122 and pad fillets 109, 111, 113 may each have the same radius, for example, about 1.52 mm (about 0.06 inches). The radii of one or more of the pressure-side pocket fillets 102, 104, 105, 120, 122 or pad fillets 109, 111, 113 may be equal to or substantially equal to the radii of one or more corners 112, 114, 116 of the pad 88. In some cases, it can be said that the radii of at least three of the pressure-side pocket fillets, for example forward fillet 102, the first side fillet 104, and the upper fillet 105, define the three corners, 112, 114, and 116, respectively. In other instances, the pressure-side pocket fillets 102, 104, 105, 120, 122 may each have the same radius, which may be different from the radii for pad fillets 109, 111, 113. In yet other instances, the pressure-side pocket fillets 102, 104, 105, 120, 122 and the pad fillets 109, 111, 113 may each have a different radius.

Figure 5:
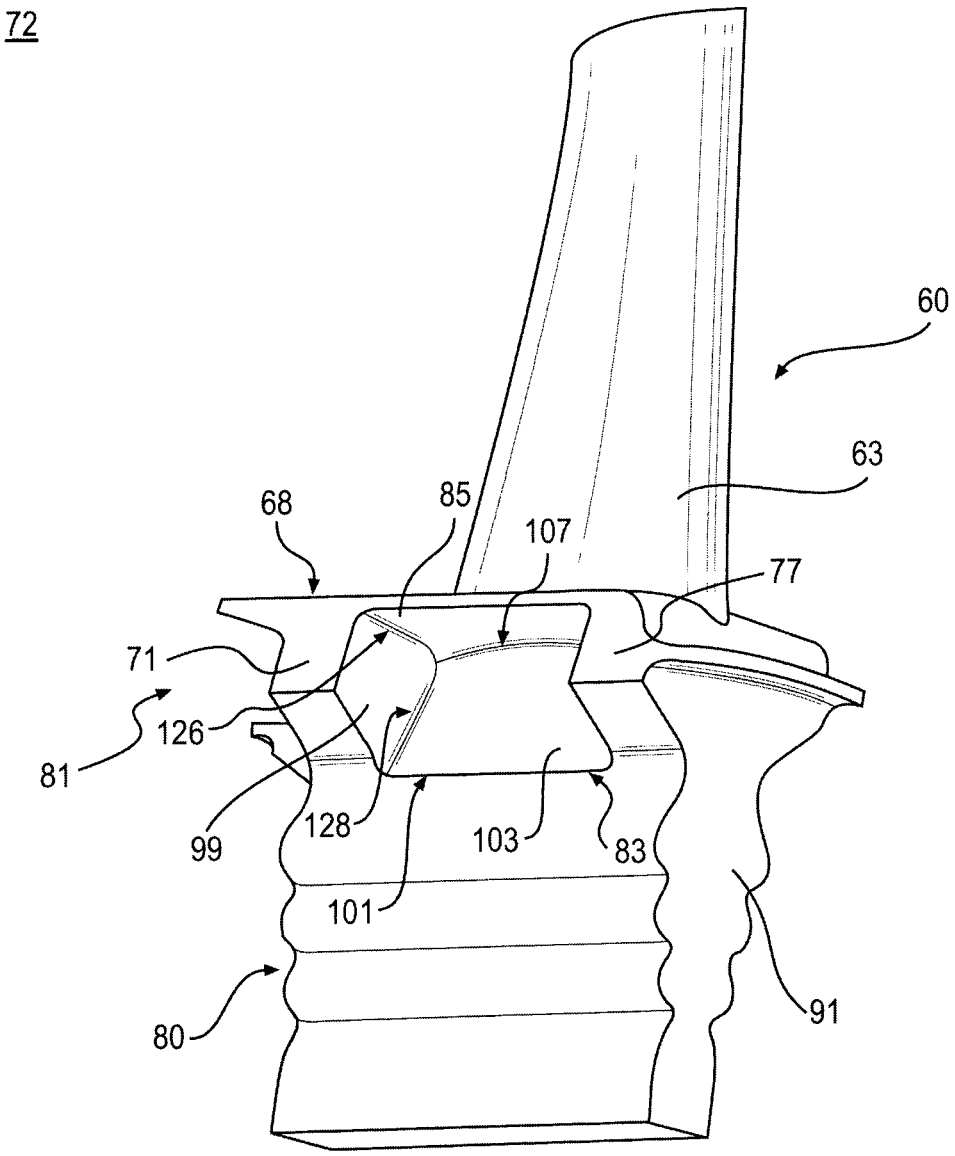
FIG. 5 is a third perspective view of the turbine blade of FIG. 2.

FIG. 5 is a third perspective view of the turbine blade 72. Specifically, FIG. 5 shows the suction side 63 of the turbine blade 72. As shown in FIG. 5, the turbine blade 72 includes a suction side forward damper arm 77 and a suction side aft damper arm 71. The damper arms 71, 77 can also be referred to as buttresses, support arms, or the like. The side of the root 80 on the suction side 63 of the turbine blade 72 includes a pocket 83, referred to herein as a "suction-side pocket." The suction-side pocket 83 can be formed beneath the platform 68, that is, at an underside of the platform 68. In some instances, the area in which the suction-side pocket 83 is formed may be an area between the platform 68 and the root 80, which can be referred to as the "shank" of the turbine blade 72. The suction-side pocket 83 may be defined by an upper wall 85, which is an underside of the platform 68, as well as a bottom edge 101, a forward wall 97 (FIG. 6), an aft wall 99, and a side wall 103.

Figure 6:
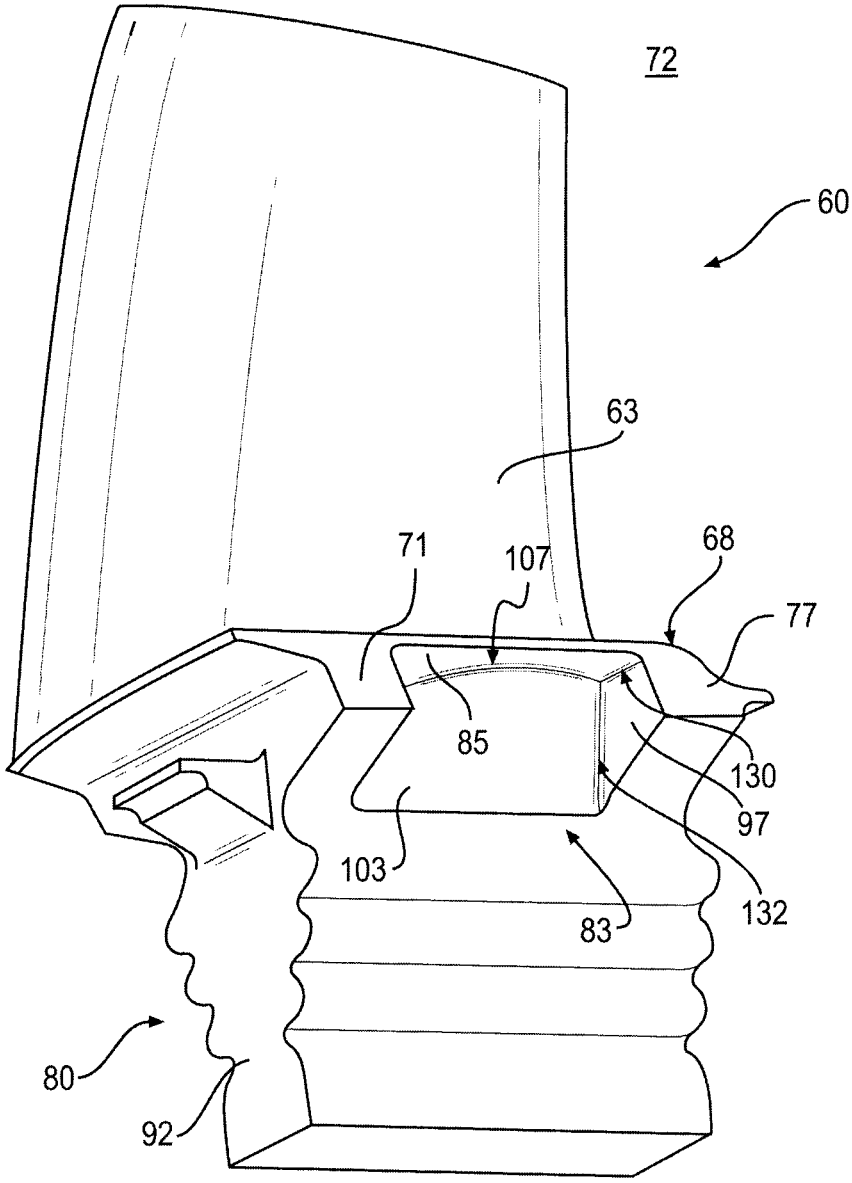
FIG. 6 is a fourth perspective view of the turbine blade of FIG. 2.

FIG. 6 is a fourth perspective view of the turbine blade 72 showing another view of the suction side 63. As shown in FIG. 6, the suction-side pocket 83 may include a forward fillet 130 formed between the upper wall 85 and the forward wall 97, an upper fillet 107 formed between the upper wall 85 and the side wall 103, and a first side fillet 132 formed between the forward wall 97 and the side wall 103. As shown in FIG. 5, the suction-side pocket 83 may also include an aft fillet 126 formed between the upper wall 85 and the aft wall 99, and a second side fillet 128 may be formed between the aft wall 99 and the side wall 103.

For the turbine blade 72 shown in FIGS. 5 and 6, the forward fillet 130, the first side fillet 132, the upper fillet 107, the aft fillet 126, and the second side fillet 128 (collectively referred to as the "suction-side pocket fillets") each have a radius defining their respective curvature. In some instances, the suction-side pocket fillets 130, 132, 107, 126, 128 may each have the same radius, for example, about 1.52 mm (about 0.06 inches). Thus, the radii of one or more of the suction-side pocket fillets 130, 132, 107, 126, 128 may be equal to or substantially equal to the radii of one or more of the aforementioned pressure-side pocket fillets 102, 104, 105, 120, 122 and/or pad fillets 109, 111, 113.

With respect to the turbine blade 72 illustrated in FIGS. 2-6, this turbine blade 72 may be, for example, from the second stage of the GTE 100 shown in FIG. 1. Regarding the pockets 82, 83, that is, the pressure-side pocket 82 and the suction-side pocket 83, they may be similar in shape and dimensions. As shown in FIGS. 5 and 6, however, the suction-side pocket 83 does not necessarily include a pad like that located in the pressure side pocket 82.

Figure 7:
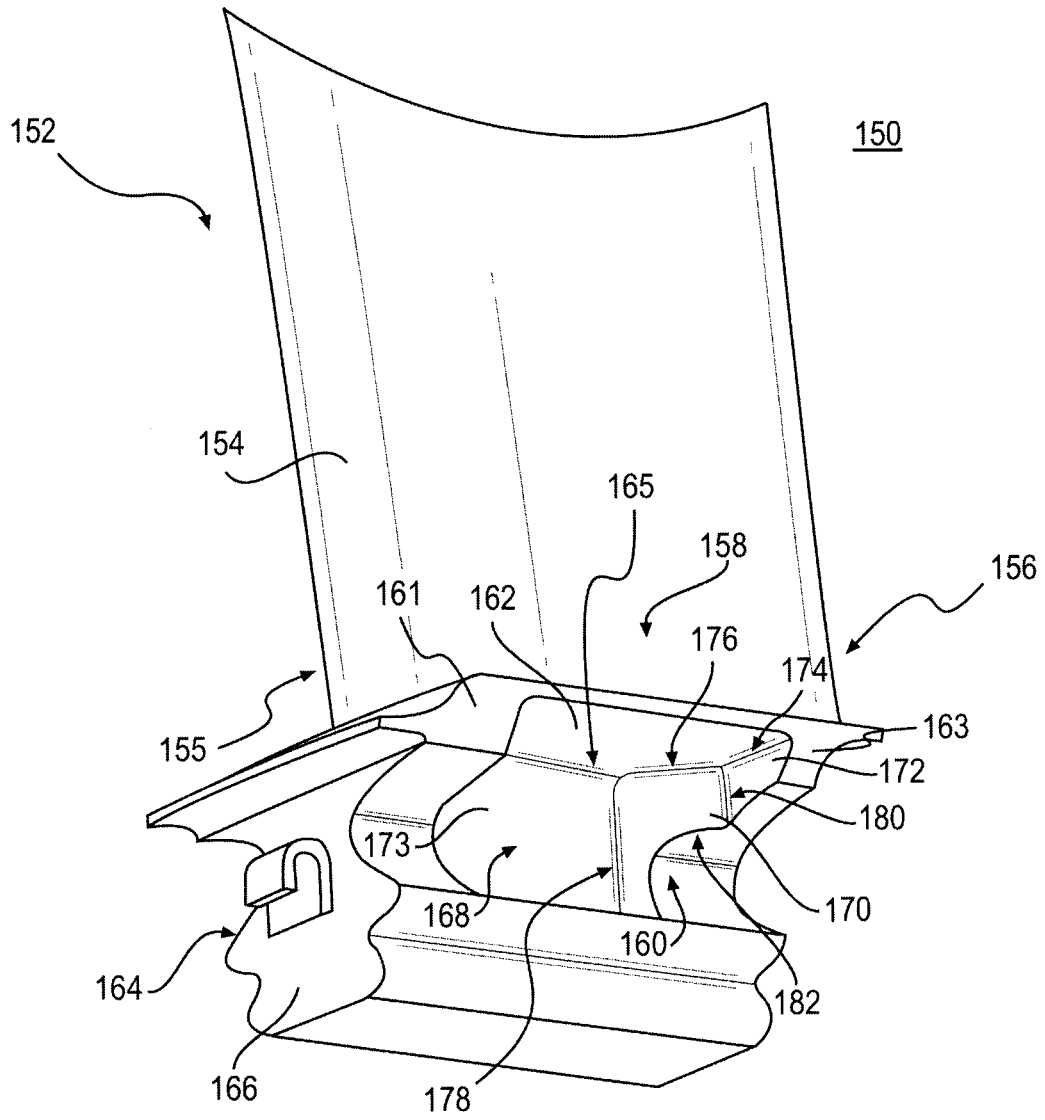
FIG. 7 is a perspective view of another embodiment of a turbine blade of the GTE.

FIG. 7 is a perspective view of another embodiment of a turbine blade 150 of the GTE 100. The turbine blade 150 of FIG. 2 includes an airfoil 152 extending in the radial direction from a turbine blade platform 158. The turbine blade 150, which is oriented in FIG. 7 to show a pressure side 154, includes a pressure side forward damper arm 161 and a pressure side aft damper arm 163. The turbine blade 150 further includes a leading edge 155 and a trailing edge 156. When the turbine blade 150 is disposed in the turbine section 70 of the GTE 100, the leading edge 155 is disposed more upstream of the flow of combustion gases than the trailing edge 156.

The turbine blade 150 further includes a root 164 extending from the platform 158, wherein the root includes a forward wall 166 and an aft wall (not shown). In some embodiments, the root 164 may exhibit a shape that can be referred to as a fir-tree shape. In other instances, however, other root shapes may be employed. As shown in FIG. 7, the turbine blade 150 includes a pocket 168, referred to herein as a "pressure-side pocket." The pressure-side pocket 168 may be formed beneath the platform 158, that is, at an underside of the platform 158, at a location between the leading edge 155 and the trailing edge 156. In some instances, the area in which the pressure-side pocket 168 is formed may be an area between the platform 158 and the root 164, which can be referred to as the neck or shank of the turbine blade 150. The pressure-side pocket 168 may be defined by an upper wall 162, which is an underside of the platform 158, as well as a forward wall (not shown), an aft wall 172, and a side wall 173.

Within the pressure-side pocket 168 of the turbine blade 150, a neck support 170 is included in a trailing corner 160 of the pressure-side pocket 168. The neck support 170 may also be referred to as a planar support, a neck gusset, a trailing-edge support, a pad, a neck pad, or the like. In some cases, the neck support 170 may be integral with the turbine blade 150. As shown in FIG. 7, the neck support 170 may be included in the trailing corner 160 of the pressure-side pocket 168 formed by the upper wall 162, the aft wall 172, and the side wall 173. The neck support 170 includes a plurality of sides, for example sides 176, 178, 180, 182, which may be referred to herein as first, second, third, and fourth sides, respectively. The neck support 170 may be flat, also referred to as planar, and rectangular or rectangle-like. In other instances, however, the neck support 170 may be either concave or convex within the pressure-side pocket 168, and exhibit a shape other than a rectangular or rectangle-like shape. As shown in FIG. 7, the pressure-side pocket may include one or more fillets, for example upper fillet 165 and aft fillet 174, which may be located adjacent the neck support 170. The upper fillet 165 and the aft fillet 174 can have dimensions similar to those of the pressure or pressure-side pocket fillets of the turbine blade 72 of FIGS. 2-6. In other instances, however, the radius of the upper fillet 165 and/or the aft fillet 174 may be less than or equal to about 1.27 mm (about 0.05 inches), or greater than or equal to about 1.78 mm (about 0.07 inches). The turbine blade 150 having the neck support 170 illustrated in FIG. 7 can be, for example, from the third stage 75 of the GTE 100 shown in FIG. 1.

INDUSTRIAL APPLICABILITY

The above-disclosed apparatus, while being described for use in a GTE, can be used generally in applications or industries requiring stiffening of components subject to high stresses. A pad, like that described with respect to the turbine blades described above, may be integrated with a component that may experience high stresses from, for example, centrifugal force.

The GTE 100 produces power by extracting energy from a flow of hot gas produced by combustion of fuel in a stream of compressed fluid, for example air, from the compressor system 10. Energy is released when a mixture of the compressed air and fuel is burned in the combustor system 20. The fuel injectors 30 direct a liquid or gaseous hydrocarbon fuel into the combustor system 20 for combustion. The resulting hot gases are directed through the turbine system 70, past the stages 73, 74, 75, over stator vanes and the turbine blades, to spin the turbine and produce mechanical power. Turbine blades rotating within the turbine system 70, for example, blades 72 rotating in the second-stage 74, may each include a support pad 88 in a pressure-side pocket as described above with respect to FIGS. 2-6. Additionally or alternatively, third stage turbine blades 150 rotating in the third stage 75 of the turbine system 70 may each include a neck support 170 in a pressure-side pocket as described above with respect to FIG. 7.

In one instance, the pad 88 of the turbine blade 72 and/or the neck support 170 of the turbine blade 150 may be formed integrally during casting, for example, investment casting, of the turbine blade 72, 150. The turbine blade 72, 150 may be cast as a single crystal.

During turbine rotation, the turbine blades may experience high stresses. For example, a given turbine blade may experience high localized stresses at locations on the pressure-side damper arms near the pressure-side pocket. These localized stresses may be a contributing factor in causing the platform, and thus the turbine blade, to fail due to crack formation and propagation. A crack may form at the area of highest stress, for example, at one of the pressure-side damper arms, and propagate upwards towards the platform. As one example, investigation of second-stage turbine blades has shown possible crack initiation and propagation along a pressure side of the root or neck near the leading edge of the blade, and extending upwards from the pressure side forward damper arm to the platform. Turbine blade failures may damage a GTE, and cause inconvenient and unscheduled shutdowns to repair and/or replace damaged GTE components.

Preventing, or at least reducing the likelihood of, turbine blade fractures and failures may extend the life of the turbine blades and improve GTE operation. This can be achieved at low cost by employing the apparatus described above. Adding the pad 88, for example by integrating the pad 88 with the turbine blade 72 during manufacturing (e.g. investment casting) can improve turbine blade durability and stiffness without adversely affecting GTE performance. The pad 88 can provide additional support to the turbine blade 72, particularly to the platform 68, to reduce the likelihood or altogether prevent the initiation and propagation of cracks. That is, the pad 88 provides a means to combat the high localized stresses applied to the turbine blades 72 during GTE operation.

As shown in FIGS. 2 and 3, the pad 88 may be located in the leading corner 86 of the pressure-side pocket 82. Locating the pad 88 in the leading corner 86 can alter the stress concentration or stress field imparted on the turbine blade 72 during GTE operation. Although leading corner 86 where the pad 88 may be located may not necessarily be the location under the greatest stress, placing the pad 88 in the leading corner 86 can have the effect of unloading the stress on the region under the highest stress. Thus, because a portion of the pressure side forward damper arm 69 may be under the highest stress, placing the pad 88 in the leading corner 86 may reduce the stress on the forward damper arm 69, which may prevent crack initiation and propagation.

Similarly, as shown in FIG. 7, the neck support 170 may be located in the pressure-side pocket 168 of the turbine blade 150. The neck support 170, however, may be positioned in the trailing corner 160 proximate the trailing edge 156. Because the pressure-side aft damper arm 163 may be under high stress, placing the neck support 170 in the trailing corner 160 can reduce the stress of the aft damper pad 163, which may prevent crack initiation and propagation proximate the trailing edge 156 of the turbine blade 150. Thus, the effect of locating the pad 88 and the neck support 170 at the above-described locations is to alter the stress loading on the turbine blade 72, 150, respectively, in order to reduce peak stresses to prevent turbine blade failure.

In some instances, the pad 88 may reduce peak stresses by about 15% or more compared to a stress value measured without the pad 88. For example, without a pad like that described above, stresses of about 198 ksi was recorded at a location on the pressure side forward damper arm of a second-stage turbine blade. When the blade was manufactured with a pad in the leading corner of the pressure-side pocket, however, a stress of about 168 ksi was recorded at the same location on the pressure side forward damper arm. Thus, addition of the above-described pad may help decrease platform stresses by about 15%, thereby enabling a longer turbine blade life. In a similar manner, for the turbine blade 150 shown in FIG. 7, the addition of the neck support 170 may reduce localized stresses on the pressure side aft damper arm from about 119 ksi to about 78.5 ksi—about a 35% reduction in localized stresses.

As described above, the pad 88 shown in FIGS. 2 and 3 has a triangular shape. While locating the pad 88 in the leading corner 86 of the pressure-side pocket 82 helps reduce localized stresses on the turbine blade 72, proving the pad 88 with a triangular shape helps to ensure these stress reductions. The triangular shape of the pad 88 in the corner formed by three walls of the pressure-side pocket 82, that is, the upper wall 84, the forward wall 94, and the side wall 96, helps to alter the stress field to unload the stress on highly stressed areas of the turbine blade, such as the pressure side forward damper arm 69. Thus, the combination of locating the pad 88 in the leading corner 86 of the pressure-side pocket 82, and providing the pad 88 in a triangular shape, may help prevent turbine blade crack initiation and propagation, which can lead to turbine blade failure.

In addition to adding the pad 88 to the turbine blade 72, the radii of one or more of the pocket fillets 102, 104, 105, 120, 122, 126, 128, 130, 132 can be reduced. In some instances, the radii of each pocket fillet 102, 104, 105, 120, 122, 126, 128, 130, 132 can be reduced, for example, from a common value of about 2.54 mm (about 0.10 inches) to about 1.52 mm (about 0.06 inches). Adding the pad 88 may increase the overall weight of the turbine blade 72. Reducing one or more of the pocket fillet radii in this manner can ensure an insignificant weight increase despite the addition of the pad 88. For example, the weight increase resulting from the addition of the pad 88 and reduction of the pocket fillet radii 102, 104, 105, 120, 122, 126, 128, 130, 132 for the turbine blade 72 may be from 1.2900 lbs. to 1.2902 lbs—an increase of only 0.0002 lbs. Although the apparatus described herein may not require a reduction in pocket fillet radii in combination with the addition of the pad 88, doing so may achieve greater durability with a minimal increase in overall turbine blade weight.

Additionally, reducing the pocket fillet radii 126, 128, 130, 132 of the suction-side pocket 83 in conjunction with providing the pad 88 and reducing the pocket fillet radii 102, 104, 105, 120, 122 of the pressure-side pocket 82 can maintain a constant blade pull while having minimum impact on blade frequencies. As the rotor disk of the turbine system rotates, the blades attached thereto may exert a force, or "pull," radially outward on the rotor disk. The amount of pull may be a function of the weight of the blade, such that a heavier blade may exert greater pull on the rotor disk. Therefore, avoiding a substantial increase in the weight of the blade by reducing the pocket fillet radii 102, 104, 105, 120, 122, 126, 128, 130, 132 can help prevent excessive blade pull on the rotor disk, which may in turn help prolong the working life of the rotors and turbine blades in the turbine system of a GTE. A similar reduction in pocket fillet radii for the turbine blade 150 shown in FIG. 7 may be provided to reduce any additional weight from the inclusion of the neck support 170.

The turbine blade 72 has been described above with respect to the second stage 74 of the turbine system 70, while the turbine blade 150 has been described with respect to the third stage 75. Each of the embodiments described above, however, may apply to other stages of the turbine system 70. For example, the pad 88 may be incorporated into a pressure-side pocket of a turbine blade in another stage of the turbine system 70, including stages beyond the third stage 75 shown in FIG. 1. Additionally, the pad 88 or similar structure could be positioned at locations other than in the leading corner 86 of the pressure-side pocket 82, for example, elsewhere in the pressure-side pocket 82, in the suction-side pocket 83, or at another location beneath the turbine blade platform 68. Additionally, the face 93 of the pad 88 may not necessarily be planar. In some instances, the face 93 may be slightly curved so as to have either a concave or a convex shape.

It will be apparent to those skilled in the art that various modifications and variations can be made to the disclosed apparatus and method of turbine blade support. Other embodiments will be apparent to those skilled in the art from consideration of the specification and practice of the disclosed system and method. It is intended that the specification and examples be considered as exemplary only, with a true scope being indicated by the following claims and their equivalents.

What is claimed is:

1. A turbine blade comprising:
- a platform;
- an airfoil extending from one side of the platform;
- a root extending from another side of the platform;
- a forward support arm extending from a forward portion of the platform;
- an aft support arm extending from an aft portion of the platform;
- a pocket located beneath the platform, wherein the pocket is between the forward and aft support arms and is defined by a forward wall on the forward support arm, an aft wall on the aft support arm, an upper wall beneath the platform, a side wall, and a bottom edge; and
- a pad disposed in a corner of the pocket, wherein the pad includes three pad corners and three sides connecting the three pad corners, and wherein each side extends along a different one of the upper wall, the side wall, and one of the forward and aft walls of the pocket.

2. The turbine blade of claim 1, wherein the corner of the pocket is a leading corner located proximate a leading edge of the turbine blade.

3. The turbine blade of claim 1, wherein the corner of the pocket is a trailing corner located proximate a trailing edge of the turbine blade.

4. The turbine blade of claim 1, wherein the pad is integral with the walls of the pocket.

5. The turbine blade of claim 1, wherein the pocket is positioned on a pressure side of the turbine blade.

6. The turbine blade of claim 1, wherein the pocket includes a plurality of fillets, wherein each fillet has a radius of about 1.52 mm.

7. The turbine blade of claim 1, wherein the pocket includes a plurality of fillets each having substantially equal radii.

8. The turbine blade of claim 1, wherein the pad is triangular.

9. The turbine blade of claim 1, wherein the three sides of the pad have substantially equal lengths.

10. The turbine blade of claim 1, wherein at least one of the pad corners is adjacent a fillet of the pocket.

11. A gas turbine engine comprising:
- a compressor system configured to compress a flow of air;
- a combustor system configured to combust a mixture of the air and a fuel to produce a hot gas flow; and
- a turbine system configured to use the hot gas flow to produce power, wherein the turbine system comprises:
- a plurality of turbine blades comprising:
  - a platform;
  - an airfoil extending radially from one side of the platform;
  - a root extending radially from another side of the platform;
  - a forward support arm extending from a forward portion of the platform;
  - an aft support arm extending from an aft portion of the platform;
  - a pocket located beneath the platform, wherein the pocket is between the forward and aft support arms and is defined by a forward wall on the forward support arm, an aft wall on the aft support arm, an upper wall beneath the platform, a side wall, and a bottom edge; and a pad disposed in a corner of the pocket, wherein the pad includes three sides, and wherein each of the three sides respectively contacts and extends along the upper wall, the side wall, and one of the forward and aft walls of the pocket.

12. The gas turbine engine of claim 11, wherein each turbine blade further comprises a pressure side and a suction side, wherein the pocket is disposed on the pressure side.

13. The gas turbine engine of claim 11, wherein the corner of the pocket is beneath a leading edge of the turbine blade, and wherein the pad is disposed adjacent the leading edge.

14. The gas turbine engine of claim 11, wherein the pad is triangular, and wherein a first side of the pad contacts a forward wall of the pocket, a second side of the pad contacts an upper wall of the pocket, and a third side of the pad contacts a side wall of the pocket.

15. The gas turbine engine of claim 11, wherein the entire pad is disposed within the pocket.

16. The gas turbine engine of claim 11, wherein the plurality of turbine blades are in a second stage of the turbine system.

17. A method of reducing stress in a turbine blade of a gas turbine engine, the turbine blade including a pressure-side pocket located beneath a platform and between a forward support arm extending below a forward portion of the platform and an aft support arm extending below an aft portion of the platform, and defined by a forward wall on the forward support arm, an aft wall on the aft support arm, an upper wall beneath the platform, a side wall, and a bottom edge, comprising:

forming a triangular pad in a corner of the pressure-side pocket of the turbine blade, wherein the pad is formed beneath the platform and proximate a leading edge of the turbine blade.

18. The method of claim 17, wherein the pad is formed integrally with the turbine blade.

19. The method of claim 17, wherein the pad is formed entirely within the pressure-side pocket.

* * * * *